US008899992B2

(12) United States Patent
Yang et al.

(10) Patent No.: US 8,899,992 B2
(45) Date of Patent: Dec. 2, 2014

(54) CONNECTOR

(71) Applicants: Chung-Chih Yang, Taipei (TW); Chung-Yuan Kuang, Taipei (TW); Kuo-Chu Liao, Taipei (TW)

(72) Inventors: Chung-Chih Yang, Taipei (TW); Chung-Yuan Kuang, Taipei (TW); Kuo-Chu Liao, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 24 days.

(21) Appl. No.: 13/794,823

(22) Filed: Mar. 12, 2013

(65) Prior Publication Data

US 2013/0267131 A1 Oct. 10, 2013

Related U.S. Application Data

(60) Provisional application No. 61/621,586, filed on Apr. 9, 2012.

(30) Foreign Application Priority Data

Feb. 6, 2013 (TW) ..... 102104647 A

(51) Int. Cl.
*H01R 12/00* (2006.01)
*H01R 13/15* (2006.01)
*H01R 24/46* (2011.01)

(52) U.S. Cl.
CPC ..... *H01R 13/15* (2013.01); *H01R 24/46* (2013.01)
USPC ..... 439/63

(58) Field of Classification Search
USPC ..... 439/63, 188, 581; 200/51.1
See application file for complete search history.

(56) References Cited

U.S. PATENT DOCUMENTS

| | | | | |
|---|---|---|---|---|
| 6,473,045 | B1 | 10/2002 | Duquerroy et al. | |
| 6,947,011 | B2 * | 9/2005 | Kukita et al. | 343/906 |
| 7,059,880 | B2 * | 6/2006 | McMaster | 439/188 |
| 7,891,979 | B2 * | 2/2011 | Chien et al. | 439/63 |

FOREIGN PATENT DOCUMENTS

| | | |
|---|---|---|
| TW | M357757 | 5/2009 |

* cited by examiner

*Primary Examiner* — Phuong Dinh
(74) *Attorney, Agent, or Firm* — Jiang Chyun IP Office

(57) ABSTRACT

A connector adapted to be disposed in a mobile device to electrically connect with a signal terminal of an electronic device is provided. The connector includes a casing, a tube, a pin and a terminal set. The casing has a first side, a second side and a through hole, and the tube is disposed in the second side. The pin has a first end and a second end. The first end is slidably disposed in the through hole and the second end protrudes out of the tube. The terminal set includes a first terminal and a second terminal, and the second terminal is movably connected with the first terminal. When the mobile device is assembled to the electronic device, the signal terminal of the electronic device leans against the pin, so that the pin leans against the first terminal to separate the first terminal and the second terminal.

12 Claims, 6 Drawing Sheets

CONNECTOR

CROSS-REFERENCE TO RELATED APPLICATION

This application claims the priority benefits of U.S. provisional application Ser. No. 61/621,586, filed on Apr. 9, 2012 and Taiwan application serial no. 102104647, filed on Feb. 6, 2013. The entirety of each of the above-mentioned patent applications is hereby incorporated by reference herein and made a part of this specification.

BACKGROUND

1. Technical Field

The disclosure relates to a connector. Particularly, the disclosure relates to a connector having a pogo pin.

2. Related Art

Along with development of technology, a plurality of portable mobile devices are continually developed. For example, notebooks, smart phones and tablet personal computers (PCs), etc. are developed to facilitate modern people to communicate with each other at anytime anywhere, and meanwhile become indispensable tools in people's daily life. In recent years, smart phones with a large size, high resolution and high-definition screen are quickly developed. Although an appearance of such type of the smart phone is similar to that of a tablet PC, it keeps the communication function, and is popular among the consumers.

In order to execute an operation having a high performance requirement, the smart phone is generally assembled to an expansion device, for example, an expansion dock. For example, the smart phone may have a very small antenna clearance zone due to a size limitation thereof, which limits antenna performance, though the size limitation of the expansion dock is smaller, so that the antenna performance is improved.

Therefore, a user can assemble the smart phone to the expansion dock to improve the communication quality of the smart phone. When the smart phone is assembled to the expansion dock, an electronic switch or a mechanical switch (for example, a coaxial connector) is first used to implement signal switch, for example, to change from the antenna of the smart phone to the antenna of the expansion dock.

Thereafter, the smart phone can use a signal connector, for example, a high frequency pogo pin to perform signal transmission. However, a multi-transmission interface co-constructed by the mechanical switch and the pogo pin is liable to cause transmission loss of a radio frequency (RF) signal, and decrease instantaneity of signal transmission.

SUMMARY

The disclosure is directed to a connector, which is capable of integrating a signal transmission function and a signal switch function to decrease signal loss caused by conversion between different interfaces during signal transmission.

The disclosure provides a connector, which is adapted to be disposed on a substrate of a mobile device to electrically connect a signal terminal and a ground terminal of an electronic device. The connector includes a casing, a tube, a pin and a terminal set.

The casing has a first side, a second side and a through hole. The tube is disposed at the second side of the casing. The pin has a first end and a second end. The first end is slidably disposed in the through hole and the second end protrudes out of the tube.

The terminal set is fixed to the first side in the casing, and the terminal set includes a first terminal and a second terminal. One end of the first terminal is electrically connected to the substrate, and another end is located corresponding to a position where the first end of the pin is slidably disposed in the through hole.

One end of the second terminal is electrically connected to the substrate, and another end is movably connected to the first terminal. When the mobile device is assembled to the electronic device, the signal terminal and the ground terminal of the electronic device respectively lean against the pin and the tube, so that the pin leans against the first terminal to separate the first terminal and the second terminal.

According to the above descriptions, in the connector of the disclosure, the pin is capable of moving in the through hole of the casing. One ends of the first terminal and the second terminal of the terminal set are electrically connected to the substrate, respectively.

When the mobile device is not yet assembled to the electronic device, the other end of the first terminal and the other end of the second terminal are contacted to each other, such that the signal of the substrate passes through the first terminal and the second terminal. When the mobile device is assembled to the electronic device, the signal terminal of the electronic device leans against the pin, such that the pin leans against the first terminal to separate the first terminal and the second terminal, and the signal of the substrate passes through the first terminal and the pin and is transmitted to the signal terminal.

The connector of the disclosure can not only change a connecting state of the first terminal and the second terminal through the pin, but can also transmit signals between the electronic device and the mobile device by using the pin, so as to decrease the signal loss caused by interface conversion.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1A:
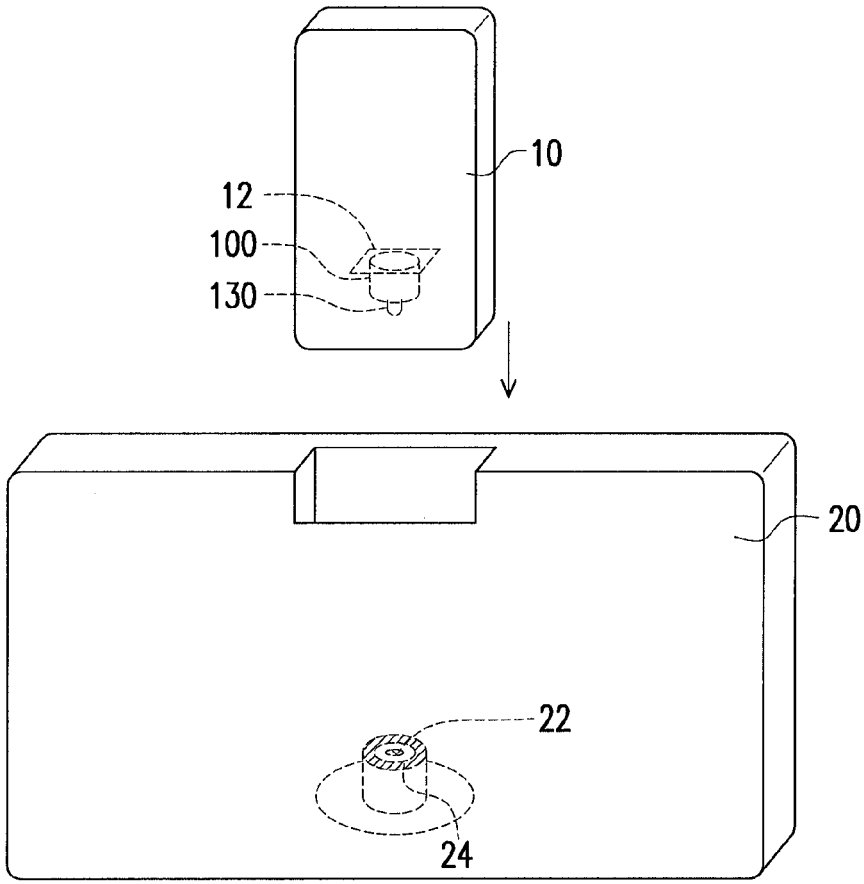
FIG. 1A is a schematic diagram of a mobile device and an electronic device according to an embodiment of the disclosure.

FIG. 1A is a schematic diagram of a mobile device and an electronic device according to an embodiment of the disclosure. FIG. 1A illustrates a mobile device 10 and an electronic device 20.

In the present embodiment, the mobile device 10 is, for example, a smart phone, though the disclosure is not limited thereto. The electronic device 20 is, for example, a tablet personal computer (PC) suitable for accommodating the smart phone, though the disclosure is not limited thereto. A connector 100 is, for example, disposed in the smart phone, and is used for connecting the tablet PC and transmitting signals. A pin 130 is for example, a pogo pin, though the disclosure is not limited thereto.

Referring to FIG. 1A to FIG. 2A, the connector 100 of the present embodiment is adapted to be disposed on a substrate 12 of the mobile device 10 to electrically connect a signal terminal 22 and a ground terminal 24 of the electronic device 20.

Figure 2A:
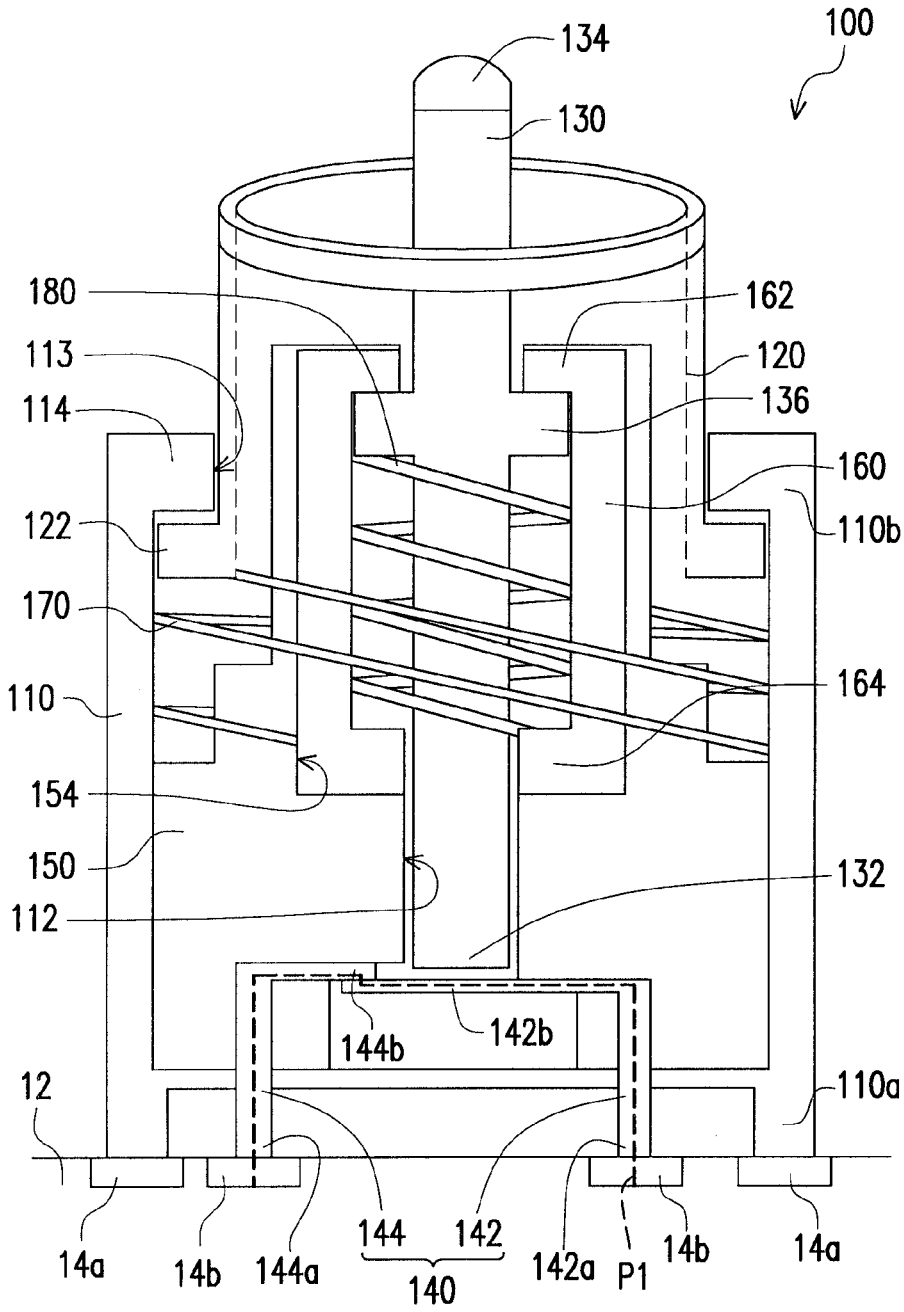
FIG. 2A is a schematic diagram of a connector of FIG. 1A.

In the present embodiment, referring to FIG. 2A, the connector 100 includes a casing 110, a tube 120, a pin 130 and a terminal set 140. The casing 110 has a first side 110*a*, a second side 110*b* and a through hole 112. The tube 120 is disposed at the second side 110*b* of the casing 110.

The pin 130 has a first end 132 and a second end 134. The first end 132 is slidably disposed in the through hole 112 and the second end 134 protrudes out of the tube 120. The terminal set 140 is fixed to the first side 110*a* in the casing 110, and the terminal set 140 includes a first terminal 142 and a second terminal 144.

One end 142*a* of the first terminal 142 is electrically connected to the substrate 12, and another end 142*b* is located corresponding to a position where the first end 132 of the pin 130 is slidably disposed in the through hole 112. One end 144*a* of the second terminal 144 is electrically connected to the substrate 12, and another end 144*b* is movably connected to the first terminal 142.

In the present embodiment, when the user uses the mobile device 10 alone, the pin 130 and the tube 120 are respectively located at an original position thereof (shown in FIG. 2A), and the other end 142*b* of the first terminal 142 and the other end 144*b* of the second terminal 144 are contacted to each other to co-construct a first signal transmission path P1. When the mobile device 10 is used alone, the mobile device 10 can use the internal antenna for communication. The signals received by the antenna are, for example, radio frequency (RF) signals, and are transmitted through the first signal transmission path P1.

Figure 1B:
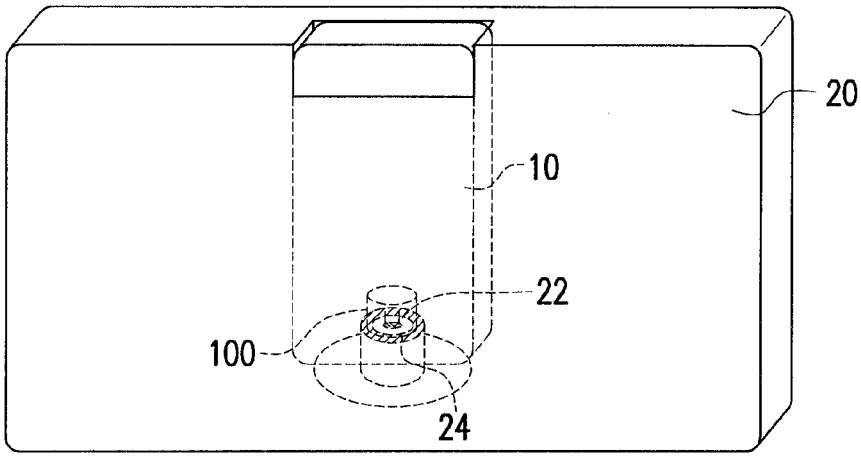
FIG. 1B is a schematic diagram of the mobile device and the electronic device of FIG. 1A that are assembled together.
Figure 1C:
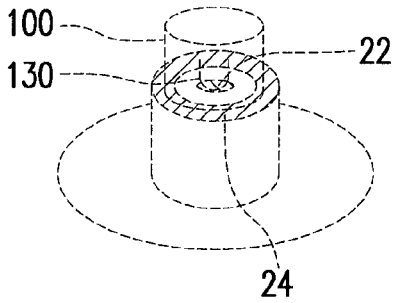
FIG. 1C is a partial enlarged diagram of FIG. 1B.
Figure 2B:
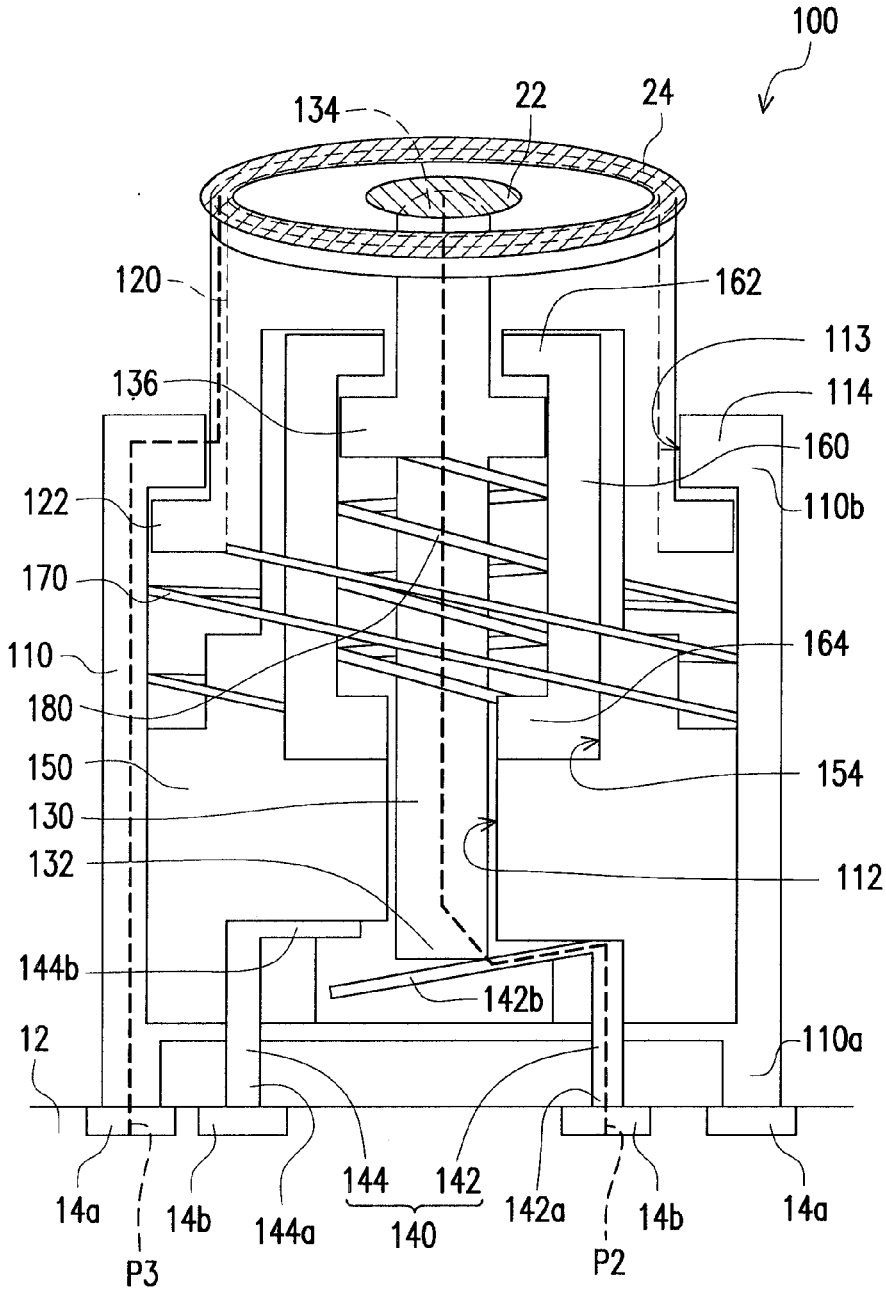
FIG. 2B is a schematic diagram of the connector of FIG. 2A in an assembling state.

Referring to FIG. 1B and FIG. 2B, when the mobile device 10 is assembled to the electronic device 20, the connector 100 leans against a motherboard in the electronic device 20, and the signal terminal 22 and the ground terminal 24 of the electronic device 20 respectively lean against the pin 130 and the tube 120, so that the pin 130 leans against the first terminal 142 to separate the first terminal 142 and the second terminal 144.

The first signal transmission path P1 constructed by the first terminal 142 and the second terminal 144 is switched to a second signal transmission path P2 constructed by the signal terminal 22, the pin 130 and the first terminal 142. Therefore, the connector 100 of the present embodiment can switch the signal transmission paths P1 and P2 through movement of positions of the pin 130 (movement between FIG. 2A and FIG. 2B). The pin 130 of the connector 100 can directly transmit signals between the electronic device 20 and the mobile device 10 to mitigate the signal loss caused by interface conversion.

Moreover, when the mobile device 10 is assembled to the electronic device 20, the ground terminal 24 on the motherboard can also lean against the tube 120, such that the ground terminal 24, the tube 120 and the casing 110 construct a third signal transmission path P3.

In the present embodiment, the casing 110 is connected to the substrate 12, and a soldering pad 14*a* connecting the casing 110 and the substrate 12 and a soldering pad 14*b* connecting the terminal set 140 and the substrate 12 are isolated to each other to avoid conduction of signals transmitted by the casing 110 and the terminal set 140.

In the present embodiment, the first signal transmission path P1 and the second signal transmission path P2 are, for example, configured to transmit RF signals, and the third signal transmission path P3 is, for example, configured to transmit a ground signal. However, types of the signals transmitted by the signal transmission paths P1, P2 and P3 are not limited by the disclosure.

In the present embodiment, the connector 100 further includes a dielectric material 150 and a positioning member 160 used for limiting a moving range of the pin 130 in the through hole 112. The dielectric material 150 is fixed in the casing 110, and the through hole 112 penetrates through the dielectric material 150.

The positioning member 160 is disposed in the through hole 112, and the positioning member 160 has a first protrusion portion 162 located away from the substrate 12 and a second protrusion portion 164 close to the substrate 12.

In FIG. 2A, the positioning member 160 is, for example, disposed in a notch 154 of the dielectric material 150, and the positioning member 160 is, for example, fixed in the dielectric material 150 through an insert-molding method, though the disclosure is not limited thereto. The pin 130 has a pin positioning portion 136, and the pin positioning portion 136 is adapted to move between the first protrusion portion 162 and the second protrusion portion 164 to limit the moving range of the pin 130.

The connector 100 further includes a first elastic member 170 and a second elastic member 180 to serve as driving sources for driving the pin 130 and the tube 120 to recover from the states shown in FIG. 2B to the original positions shown in FIG. 2A when the mobile device 10 is taken away from the electronic device 20. The first elastic member 170 is disposed between the tube 120 and the dielectric material 150. The second elastic member 180 sleeves the pin 130, and the second elastic member 180 is connected to the pin 130 and the second protrusion portion 164.

When the mobile device 10 is assembled to the electronic device 20, the pin 130 and the tube 120 move relative to the casing 110, and the second elastic member 180 and the first elastic member 170 store elastic potential energy (for example, the elastic members are compressed). When the mobile device 10 is disassembled from the electronic device 20, the second elastic member 180 and the first elastic member 170 release the elastic potential energy to drive the pin 130 and the tube 120 to recover to the original positions thereof. In the present embodiment, the first elastic member 170 and the second elastic member 180 are, for example, springs, which is not limited by the disclosure.

When the second elastic member 180 releases the elastic potential energy to drive the pin 130 to recover to its original position, the pin 130 is fixed to its original position as the pin positioning portion 136 leans against the first protrusion portion 162, so as to prevent the pin 130 from falling off.

In an embodiment, the casing 110 has a casing stop portion 114 disposed around a casing opening 113 of the casing 110. The tube 120 slidably disposed in the casing 110 correspondingly has a tube stop portion 122. When the first elastic member 170 releases the elastic potential energy to drive the tube 120 to recover to its original position, the casing stop portion 114 leans against the tube stop portion 122 to prevent the tube 120 from ejecting out of the casing 110.

In the present embodiment, the terminal set 140 is fixed in the dielectric material 150 and is electrically connected to the substrate 12. In detail, in FIG. 2A, the end 142*a* of the first terminal 142 and the end 144*a* of the second terminal 144 are, for example, soldered to the soldering pad 14*b* of the substrate 12 through a reflow process to electrically connect the substrate 12. Moreover, to prevent the terminal set 140 from contacting the casing 110, a part of the structure of the first terminal 142 other than the end 142*a* and the other end 142*b* is embedded in the dielectric material 150. Similarly, a part of the structure of the second terminal 144 other than the end 144*a* and the other end 144*b* is also embedded in the dielectric material 150.

When the mobile device 10 is not yet assembled to the electronic device 20, the other end 142*b* of the first terminal 142 and the other end 144*b* of the second terminal 144 are contacted to each other to co-construct the first signal transmission path P1.

For example, regarding a manner that the first terminal 142 contacts the second terminal 144, the other end 142*b* of the first terminal 142 leans against a lower edge of the other end 144*b* of the second terminal 144. The other end 142*b* of the first terminal 142 can be leaned against and pushed by the pin 130 when the pin 130 moves relative to the casing 110, and can co-construct the second signal transmission path P2 in collaboration with the pin 130 to implement a function of switching the signal transmission paths P1 and P2. However, the structure and operation method of the terminal set 140 is not limited by the disclosure. Another embodiment is provided below for descriptions.

Figure 3A:
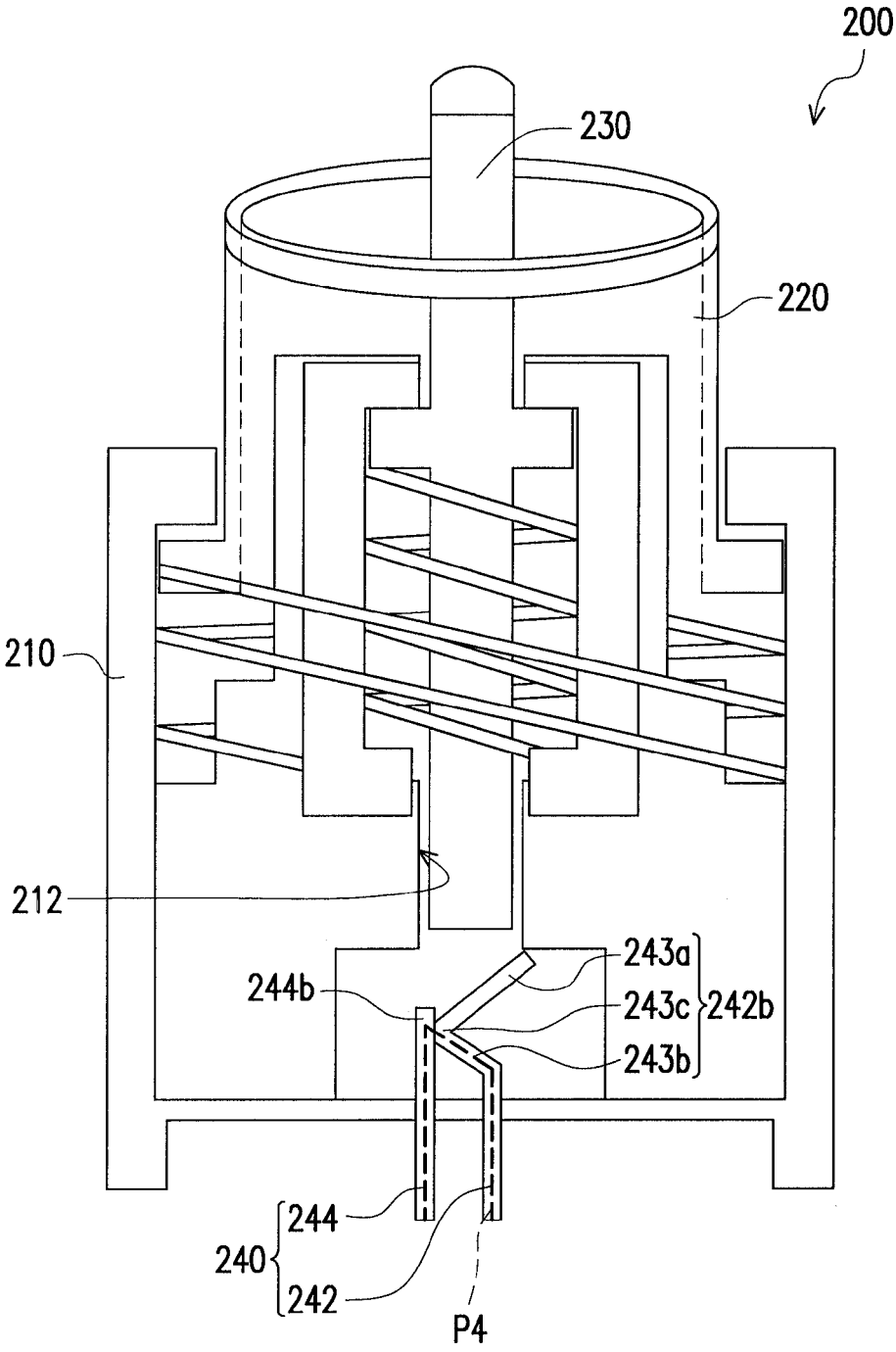
FIG. 3A is a schematic diagram of a connector according to another embodiment of the disclosure.
Figure 3B:
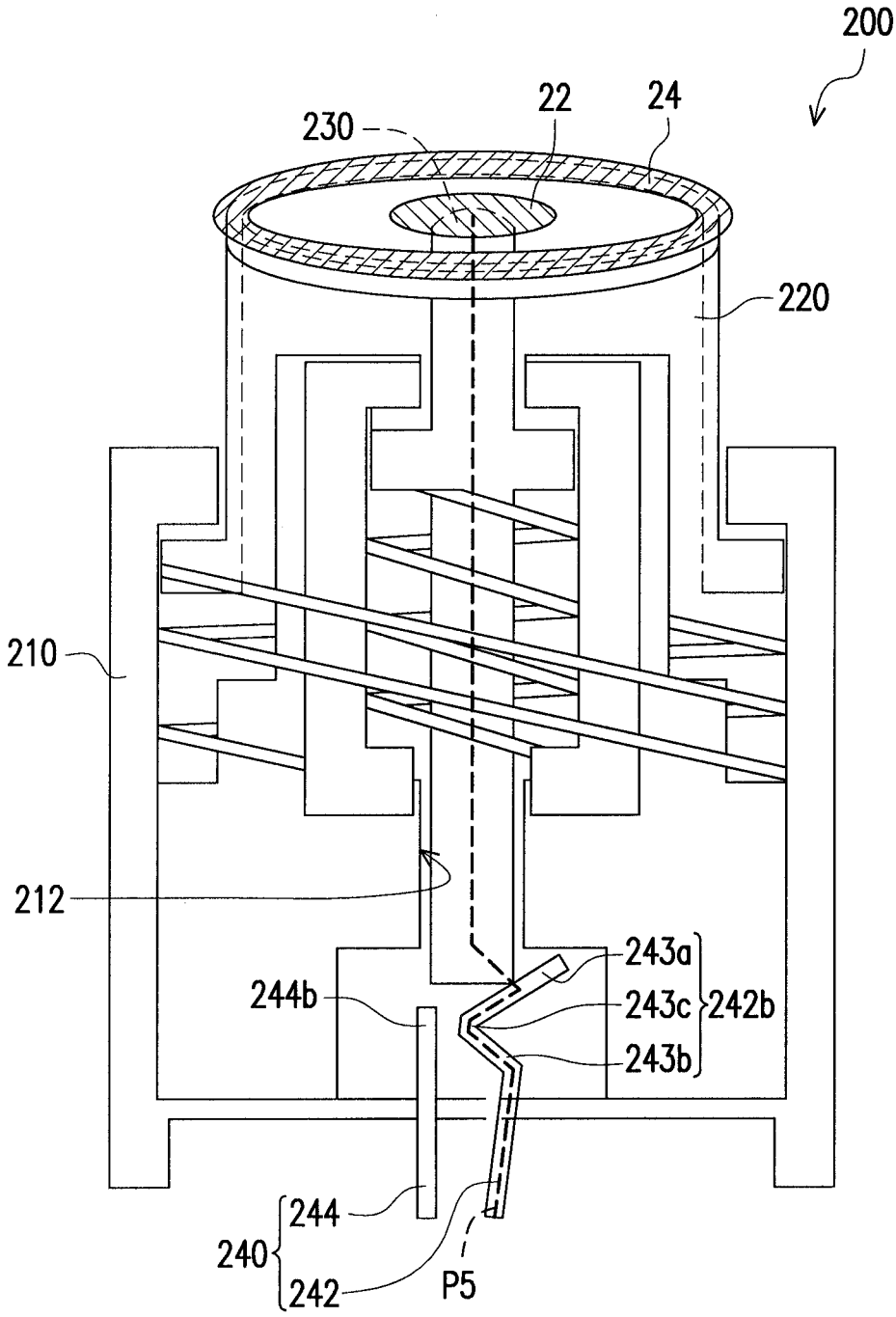
FIG. 3B is a schematic diagram of the connector of FIG. 3A in an assembling state.

FIG. 3A is a schematic diagram of a connector according to another embodiment of the disclosure. FIG. 3B is a schematic diagram of the connector of FIG. 3A in an assembling state. Referring to FIG. 3A and FIG. 3B, the connector 200 includes a casing 210, a tube 220, a pin 230 and a terminal set 240.

However, extending directions of a first terminal 242 and a second terminal 244 are parallel to a direction of a through hole 212. The other end 242*b* of the first terminal 242 has two inclined surfaces 243*a* and 243*b* adjacent to each other, and a bump 243*c* is formed at a junction of the two inclined surfaces 243*a* and 243*b*. When the first terminal 242 and the second terminal 244 form a first signal transmission path P4, the other end 242*b* of the first terminal 242 leans against the other end 244*b* of the second terminal 244 through the bump 243*c*.

In the present embodiment, when the mobile device 10 is assembled to the electronic device 20, the pin 230 moves in the through hole 212, and the pin 230 leans against the inclined surface 243*a*. As a moving distance of the pin 230 increases, the pin 230 moves on the inclined surface 243*a* to drive the first terminal 242 to move outward. When the pin 230 is located at a position as that shown in FIG. 3B, the pin 230 leans against the first terminal 242 to form a second signal transmission path P5, and the first terminal 242 and the second terminal 244 are not contacted. In this way, an effect of switching the signal transmission path is also achieved.

In summary, in the connector of the disclosure, the pin is slidably disposed in the through hole of the casing. When the mobile device is not yet assembled to the electronic device, the first terminal and the second terminal co-construct the first signal transmission path. When the mobile device is assembled to the electronic device, the signal terminal of the electronic device leans against the pin, and pushes the pin to move relative to the casing, such that the pin leans against the first terminal to switch the first signal transmission path to the second signal transmission path.

Moreover, the tube can also slide relative to the casing and leans against the casing, so as to construct the third signal transmission path in collaboration with the ground terminal of the electronic device. Moreover, when the mobile device is taken away from the electronic device, the elastic members serve as a driving source to recover the original positions of the pin and the tube. Therefore, the connector of the disclosure can not only change a signal transmission path of the signal terminal through movement of the pin, but can also transmit signals between the electronic device and the mobile device by using the pin, which avails decreasing the signal loss caused by interface conversion.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A connector, adapted to be disposed on a substrate of a mobile device to electrically connect a signal terminal and a ground terminal of an electronic device, the connector comprising:

a casing, having a first side, a second side and a through hole;

a tube, disposed at the second side of the casing;

a pin, having a first end and a second end, wherein the first end is slidably disposed in the through hole and the second end protrudes out of the tube; and a terminal set, fixed to the first side in the casing, and comprising:

a first terminal, having one end electrically connected to the substrate, and another end located corresponding to a position where the first end of the pin is slidably disposed in the through hole; and a second terminal, having one end electrically connected to the substrate, and another end movably connected to the first terminal, wherein when the mobile device is assembled to the electronic device, the signal terminal and the ground terminal of the electronic device respectively lean against the pin and the tube, so that the pin leans against the first terminal to separate the first terminal and the second terminal.

2. The connector as claimed in claim 1, wherein when the mobile device is not yet assembled to the electronic device, the second terminal is connected to the first terminal to form a first signal transmission path, and when the mobile device is assembled to the electronic device, the second terminal and the first terminal are separated to form a second signal transmission path.

3. The connector as claimed in claim 2, wherein the first signal transmission path and the second signal transmission path are adapted to transmit a radio frequency signal.

4. The connector as claimed in claim 2, wherein when the mobile device is assembled to the electronic device, the second end leans against the signal terminal for electrical connection, the first end of the pin leans against the first terminal to switch the first signal transmission path to the second signal transmission path.

5. The connector as claimed in claim 1, further comprising:

a dielectric material, fixed in the casing, wherein the through hole penetrates through the dielectric material; and a positioning member, disposed in the through hole, and having a first protrusion portion located away from the substrate and a second protrusion portion close to the substrate, wherein the pin has a pin positioning portion, and the pin positioning portion is adapted to move between the first protrusion portion and the second protrusion portion to limit a moving range of the pin.

6. The connector as claimed in claim 5, further comprising:

a first elastic member, disposed between the tube and the dielectric material; and a second elastic member, sleeving the pin, and connected to the pin and the second protrusion portion, wherein when the pin and the tube move relative to the casing, the second elastic member and the first elastic member store elastic potential energy, and when the mobile device is disassembled from the electronic device, the second elastic member and the first elastic member release the elastic potential energy to drive the pin and the tube to recover to original positions thereof.

7. The connector as claimed in claim 6, wherein when the second elastic member releases the elastic potential energy to drive the pin to recover to the original positions, the pin positioning portion leans against the first protrusion portion.

8. The connector as claimed in claim 6, wherein the casing has a casing stop portion disposed around a casing opening of the casing, the tube has a tube stop portion, and when the first elastic member releases the elastic potential energy to drive the tube to recover to the original positions thereof, the casing stop portion leans against the tube stop portion.

9. The connector as claimed in claim 6, wherein the first elastic member and the second elastic member are springs.

10. The connector as claimed in claim 1, wherein the end of the first terminal and the end of the second terminal are electrically connected to the substrate through soldering.

11. The connector as claimed in claim 2, wherein when the first terminal and the second terminal construct the first signal transmission path, the other end of the first terminal leans against a lower edge of the other end of the second terminal.

12. The connector as claimed in claim 2, wherein when the first terminal and the second terminal construct the first signal transmission path, the other end of the first terminal has two inclined surfaces adjacent to each other, and the first terminal leans against the other end of the second terminal through a bump formed at a junction of the two inclined surfaces.

* * * * *

UNITED STATES PATENT AND TRADEMARK OFFICE

CERTIFICATE OF CORRECTION

PATENT NO. : 8,899,992 B2
APPLICATION NO. : 13/794823
DATED : December 2, 2014
INVENTOR(S) : Chung-Chih Yang, Chung-Yuan Kuang and Kuo-Chu Liao It is certified that error appears in the above-identified patent and that said Letters Patent is hereby corrected as shown below:

On the title page item (73) Assignee's Name

"ASUSTek Computer Inc." should be changed to -- ASUSTeK COMPUTER INC. --.

Signed and Sealed this
Twenty-fourth Day of March, 2015

Michelle K. Lee

Michelle K. Lee
*Director of the United States Patent and Trademark Office*